US012253344B2

(12) United States Patent
Matsubara et al.

(10) Patent No.: US 12,253,344 B2
(45) Date of Patent: Mar. 18, 2025

(54) DART

(71) Applicant: Cosmo Seiki Co., Ltd., Toon (JP)

(72) Inventors: Hiroaki Matsubara, Matsuyama (JP); Masayuki Matsubara, Toon (JP)

(73) Assignee: Cosmo Seiki Co., Ltd., Ehime (JP)

( * ) Notice: Subject to any disclaimer, the term of this patent is extended or adjusted under 35 U.S.C. 154(b) by 0 days.

(21) Appl. No.: 18/401,157

(22) Filed: Dec. 29, 2023

(65) Prior Publication Data

US 2024/0133663 A1 Apr. 25, 2024

Related U.S. Application Data

(63) Continuation of application No. 17/744,716, filed on May 15, 2022, now Pat. No. 11,920,911, which is a (Continued)

(30) Foreign Application Priority Data

Nov. 19, 2019 (JP) ..... 2019-208365

(51) Int. Cl.
*F42B 6/06* (2006.01)
*A63B 65/02* (2006.01)
*F42B 6/00* (2006.01)

(52) U.S. Cl.
CPC ..... *F42B 6/003* (2013.01); *F42B 6/06* (2013.01)

(58) Field of Classification Search
CPC ..... F42B 6/003; F42B 6/06
See application file for complete search history.

(56) References Cited

U.S. PATENT DOCUMENTS 2,887,319 A 5/1959 Lay
3,749,403 A 7/1973 Austin et al.
(Continued)

FOREIGN PATENT DOCUMENTS

GB 2052277 A 1/1981
GB 2100994 A 1/1983
(Continued)

OTHER PUBLICATIONS

"Isn't L-style dimple good?", FC2 (online), May 26, 2014 (retrieved Oct. 23, 2020), Internet: <http://shelterfromthestorm8.blog.fc2.com/blog-entry-278.html>. ISR in PCT/JP2020/035310 submitted in lieu of concise English-language explanation. See NPL Cite No. 2.
(Continued)

*Primary Examiner* — John A Ricci
(74) *Attorney, Agent, or Firm* — JTT Patent Services, LLC; Gerald T. Peters

(57) ABSTRACT

A dart may comprise—in order from the front thereof—a point, a barrel, a shaft, and a flight. The flight may comprise a plurality of fins. The fins may comprise mesh-like reinforcing ribs that protrude from surfaces thereof. The fins may further comprise, at peripheries thereof, fin rims formed so as to be of increased thickness. Reinforcing ribs may be formed over the approximate entireties of the fins. The shaft may comprise an insertion portion at the back end thereof. The flight may comprise a central axial hole having an opening at the front end thereof. The shaft may be removably installable with respect to the flight by virtue of a cap-like arrangement by which the insertion portion is inserted within, and is coupled and secured to, the central axial hole. The central axial hole may be formed from the front end of the flight to the back end thereof.

20 Claims, 8 Drawing Sheets

Related U.S. Application Data continuation-in-part of application No. PCT/JP2020/035310, filed on Sep. 17, 2020.

(56) References Cited

U.S. PATENT DOCUMENTS

| | | | | |
|---|---|---|---|---|
| 3,913,917 | A | 10/1975 | Coxon | |
| 3,995,861 | A | 12/1976 | Clarke | |
| 4,114,884 | A | 9/1978 | Tunnicliffe | |
| 4,958,838 | A | 9/1990 | Farler | |
| 4,978,130 | A | 12/1990 | Farler | |
| 5,024,448 | A | 6/1991 | Barrie | |
| 5,642,887 | A | 7/1997 | Orav | |
| 6,533,688 | B1 | 3/2003 | Huang | |
| 7,331,888 | B2 | 2/2008 | Jirles | |
| 8,038,552 | B2 | 10/2011 | Song | |
| 8,177,668 | B2 | 5/2012 | Matsubara | |
| 9,435,620 | B2 | 9/2016 | Hamazaki et al. | |
| 11,920,911 | B2 * | 3/2024 | Matsubara | F42B 6/003 |

FOREIGN PATENT DOCUMENTS

| | | | |
|---|---|---|---|
| GB | 2310809 | A | 9/1997 |
| JP | S49-135200 | U1 | 11/1974 |
| JP | S57-103770 | U1 | 6/1982 |
| JP | 4350154 | B1 | 10/2009 |
| JP | 2011-110413 | A | 6/2011 |
| JP | 2008-229285 | A | 4/2023 |
| WO | 2007000983 | A1 | 1/2007 |

OTHER PUBLICATIONS

International Search Report dated Nov. 2, 2020 in PCT/JP2020/035310 which published as WO 2021 100306 A1 on May 27, 2021 and which is the International Application of which the present application is a continuation-in-part. Submitted for Frn Pat Doc Cite No 1 and NPL Cite No 1. Submitted additionally for US Pat Cite No 1 and for Frn Pat Doc Cite Nos. 2-4.

Applicant brings to the attention of the Examiner the existence of possibly related U.S. Appl. No. 12/553,148, filed Sep. 3, 2009, published as US 2010 0062882 A1 on Mar. 11, 2010, and issued as U.S. Pat. No. 8,177,668 B2 on May 15, 2012, which is the US counterpart of Frn Pat Doc Cite No. 3, and which has overlapping inventorship/ ownership as in the present case.

Applicant brings to the attention of the Examiner the existence of possibly related U.S. Appl. No. 11/920,911, published as US 2022 0268560 A1 on Aug. 25, 2022, and issued as U.S. Pat. No. 11,920,911 B2 on Mar. 5, 2024, which has overlapping inventorship/ ownership as in the present case.

* cited by examiner (a)

(b)

DART

CROSS-REFERENCE TO RELATED APPLICATION, BENEFIT/PRIORITY CLAIM(S), AND INCORPORATION BY REFERENCE

This application is a continuation of and claims benefit under 35 USC 120 to copending U.S. patent application Ser. No. 17/744,716, entitled "Dart", filed 15 May 2022, which is a continuation-in-part of and claims benefit under 35 USC 120 and 365(c) to International Application No PCT/JP2020/035310, entitled "Dart", filed 17 Sep. 2020, the aforesaid International Application No PCT/JP2020/035310 having been copending at the time of filing of the aforesaid U.S. patent application Ser. No. 17/744,716; and further claims benefit of priority under 35 USC 119(a)-(d) to Japanese Patent Application No 2019-208365, entitled "Dart", filed 19 Nov. 2019, the contents of all of which applications are incorporated herein in their entireties by reference.

STATEMENT REGARDING PRIOR DISCLOSURES BY INVENTOR UNDER 37 CFR 1.77(b)(6)

The following patents and published patent applications are disclosures by, originating with, and/or attributable to the inventor of the present application:

JP 4350154 B1 ("Dart"; 21 Oct. 2009);
US 2010 0062882 A1 ("Dart"; 11 Mar. 2010);
CN 101670171 A ("Dart"; 17 Mar. 2010);
GB 2463349 A ("Dart"; 17 Mar. 2010);
JP 2010 063582 A ("Dart"; 25 Mar. 2010);
GB 2463349 B ("Dart"; 18 Aug. 2010);
U.S. Pat. No. 8,177,668 B2 ("Dart"; 15 May 2012);
CN 101670171 B ("Dart"; 8 May 2013);
JP 2021 078698 A ("Dart"; 27 May 2021);
WO 2021 100306 A1 ("Dart"; 27 May 2021);
CN 114728193 A ("Dart"; 8 Jul. 2022);
US 2022 0268560 A1 ("Dart"; 25 Aug. 2022); and
GB 2604476 A ("Dart"; 7 Sep. 2022).

FIELD OF THE INVENTION

The present invention relates to a dart for use in the game of darts.

BACKGROUND

The game of darts is a sport in which players compete for points based on locations struck by arrow-like projectiles (darts) thrown at a target (dartboard) which may be mounted on a wall or the like.

In accordance with one embodiment, a dart may be constructed by connecting component parts including—in order from the front which is the side thereof that is to strike the target—a point (tip), a barrel, a shaft, and a flight.

When competing at darts, each player might for example take his turn by throwing three darts one-at-a-time at the target, at which time it may be that a player will aim for a narrow region within which the same number of points would be received, for which reason it is often the case that the flight of a dart which has previously been made to lodge in the target will be subject to collision by the point, barrel, and/or flight of a subsequently thrown dart. Where such collisions occur repeatedly, there will be occurrence of cracking at the fins of the flight; and once there has been occurrence of cracking, it will moreover be the case that such cracks will be made to grow progressively larger in size with each successive impact that is incident thereon.

Furthermore, the impact suffered by darts which do not lodge in the target but which fall to the floor may also cause damage due to occurrence of cracking at the fins of the flight. As the flight of a dart is a component that has a large effect on the aerodynamic balance of the dart, presence of a crack in the fins of the flight will alter its trajectory, causing it to be a not infrequent event that the dart will fail to strike the intended location.

In accordance with one embodiment, by causing the fins of the flight to be thin and/or by using soft material as flight material so as to impart the fins with flexibility, it is possible to achieve a situation in which the fins of the flight deform at the time of a collision, thus making it possible to reduce or eliminate the force of impact that would otherwise result from the collision, and making it possible to prevent damage to the fins.

However, in embodiments in which thin, highly flexible fins are employed, there may be occurrence of problems whereby fins may undergo deformation while in flight or fins may undergo deformation when in a high-temperature environment, or it may be the case that residual stress from injection molding during manufacture causes occurrence of torsional deformation at the fins, resulting in aerodynamic instability. Furthermore, once cracking has occurred at a thin fin, the speed with which the size of the crack grows progressively larger is greater than would be the case with a thick fin.

On the other hand, by in accordance with another embodiment causing fins to be thick or by using hard material as flight material so as to impart fins with rigidity, it is possible to prevent damage to fins as a result of collision. However, it may be the case with such an embodiment that when the fins of a dart that is already lodged in the board are no longer able to deform, a subsequent dart colliding therewith will be more likely to bounce off therefrom, as a result of which there will be an increase in the frequency with which the dart does not become lodged in the board at the intended location or that it fails to become lodged therein at all and instead falls to the floor. Furthermore, in such an embodiment, causing fins to be thick or using hard material thereat may increase the weight of the fins, and the increase in the weight of the rear portion of the dart may cause the aerodynamic balance thereof to worsen.

There is therefore a need to provide a dart that tends not to undergo damage and that prevents occurrence of aerodynamic instability due to deformation of fins despite the fact that the fins of the flight are imparted with flexibility.

SUMMARY OF INVENTION

A dart associated with one embodiment of the present invention, in the context of a dart comprising—in order from the front thereof—a point, barrel, shaft, and flight, may be such that the flight comprises a plurality of fins, and/or may be such that the fins comprise mesh-like reinforcing ribs which protrude from the surface.

In accordance with such an embodiment of the present invention, formation of reinforcing ribs at fins may make it possible for a dart associated with an embodiment of the present invention to tend not to undergo damage and for occurrence of aerodynamic instability due to deformation of fins to be prevented despite the fact that the fins of the flight are imparted with flexibility.

Other embodiments, systems, methods, and features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

EMBODIMENTS FOR CARRYING OUT INVENTION

Figure 1:
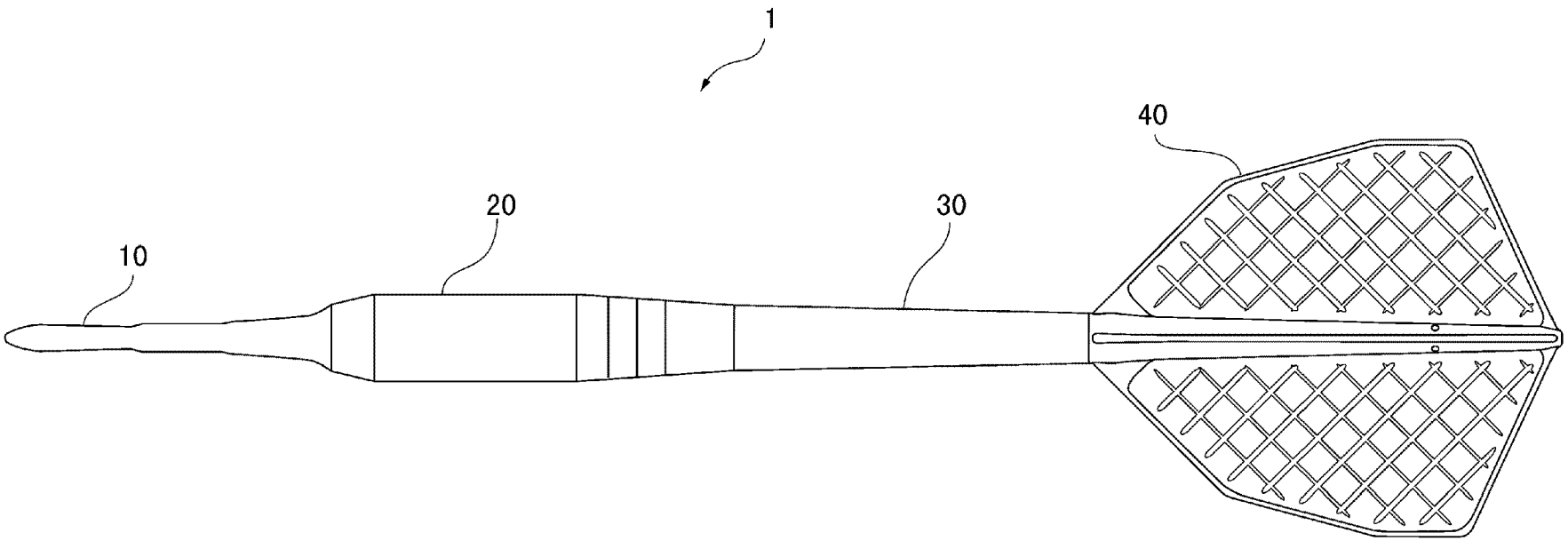
FIG. 1 is a front view of a dart associated with an embodiment of the present invention.

Below, embodiments of the present invention are described with reference to the drawings. As shown in FIG. 1, dart 1 in accordance with one embodiment may comprise point (tip) 10, barrel 20, shaft 30, and flight 40, which may be installed in coupled fashion in order from the front, dart 1 of the present embodiment employing a cap-like arrangement in which flight 40 is removably installed at the back end of shaft 30.

Male threads may be formed at the back end of point 10, threaded engagement of the male threads at the back end of point 10 with female threads formed at the front end of barrel 20 permitting point 10 and barrel 20 to be coupled and secured in coaxial fashion with respect to the axis of dart 1.

As the material of point 10, stainless steel, titanium, or other such metal, or polyacetal (POM), polyimide (PA), or other such plastic may be used. As the material of barrel 20, besides tungsten which is a high-density metal, stainless steel, copper, or the like may be used.

Figure 2:
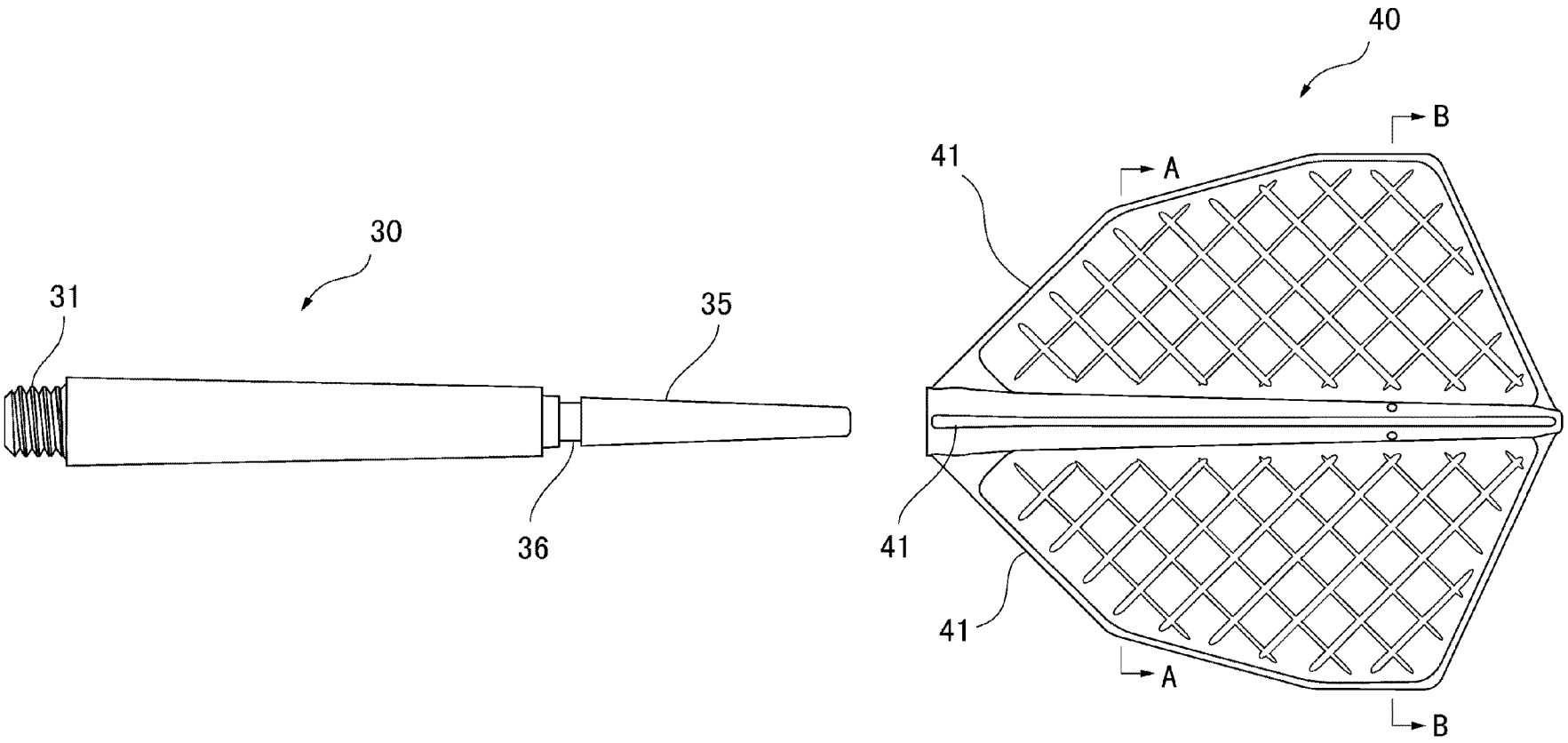
FIG. 2 is a front view of the flight and shaft associated with an embodiment of the present invention when disassembled.

As shown in FIG. 2, shaft 30 may comprise male threads 31 formed at the front end thereof, and insertion portion 35 formed at the back end thereof. Female threads may be formed at the back end of barrel 20, threaded engagement of the male threads 31 at the front end of shaft 30 with the female threads at the back end of barrel 20 permitting barrel 20 and shaft 30 to be coupled and secured.

Insertion portion 35 of shaft 30—which is the portion thereof that is inserted into central axial hole 46, described below, of flight 40—may be narrower than the main portion of shaft 30. Groove recess 36 may be formed circumferentially about the axis in the vicinity of the base (front end) of insertion portion 35.

As the material of shaft 30, polypropylene (PP), polyimide (PA), polystyrene (PS), polycarbonate (PC), or polyacetal (POM), or other such synthetic resin, or aluminum or other such metal, may be used. If synthetic resin is used, for example, shaft 30 may be integrally formed by injection molding.

Figure 3:
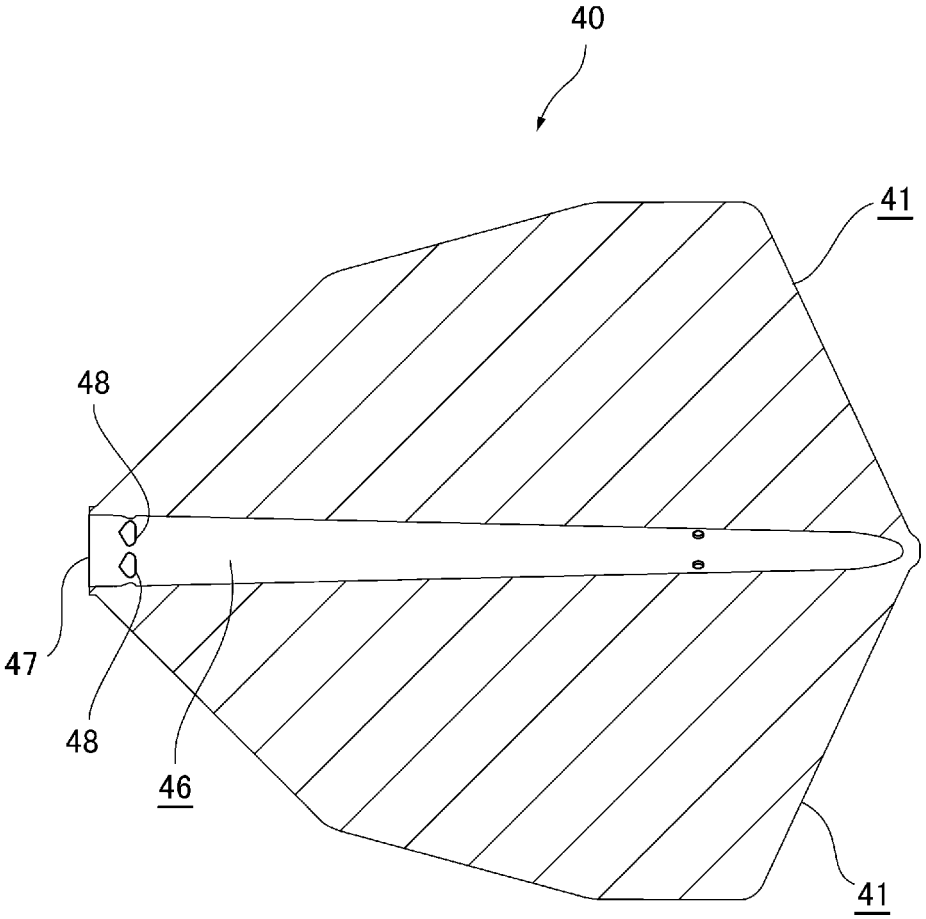
FIG. 3 is a sectional view of a flight associated with an embodiment of the present invention.
Figure 4:
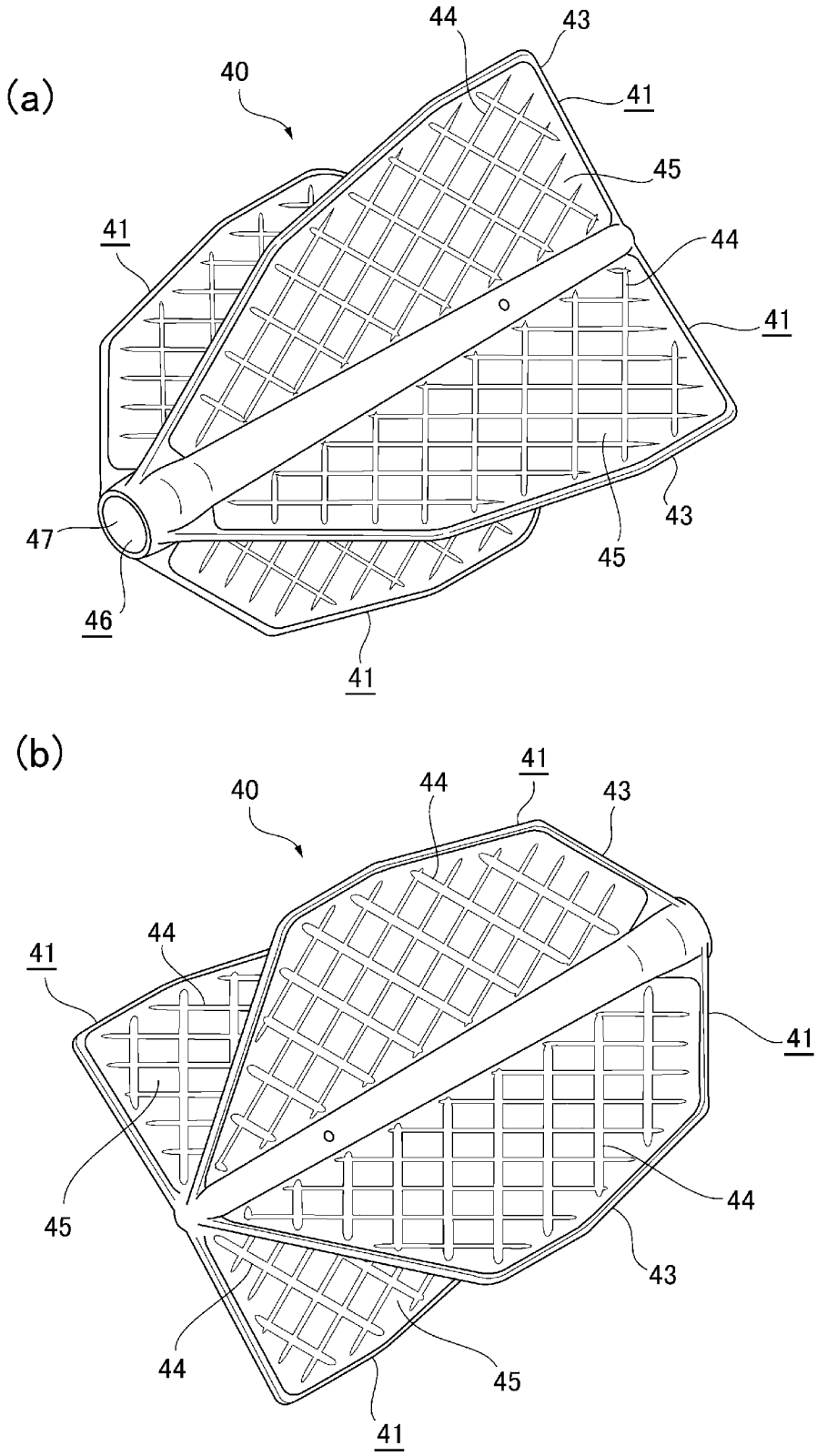
FIG. 4 is a perspective view of a flight associated with an embodiment of the present invention.
Figure 5:
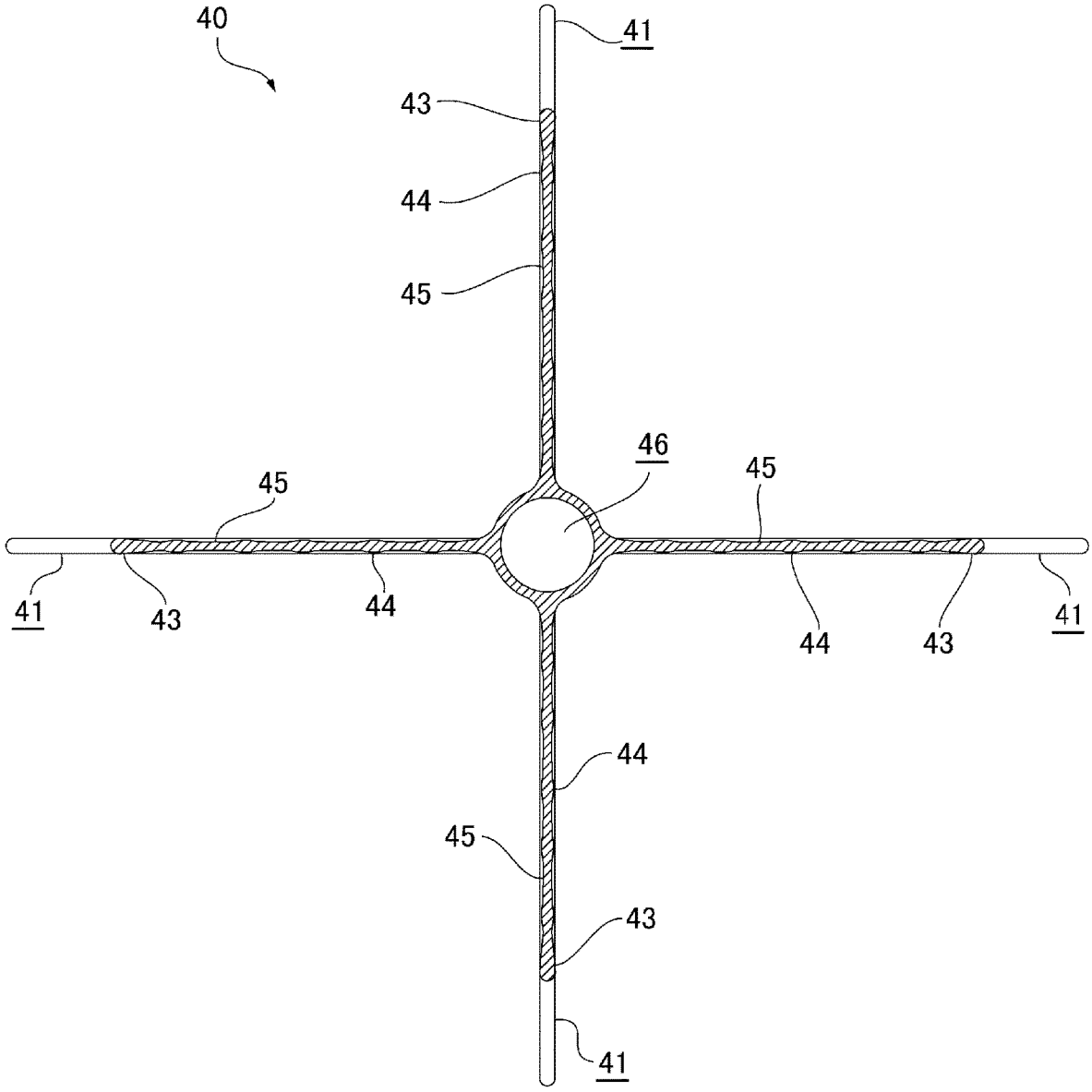
FIG. 5 is a view of a section taken along A-A in FIG. 2.
Figure 6:
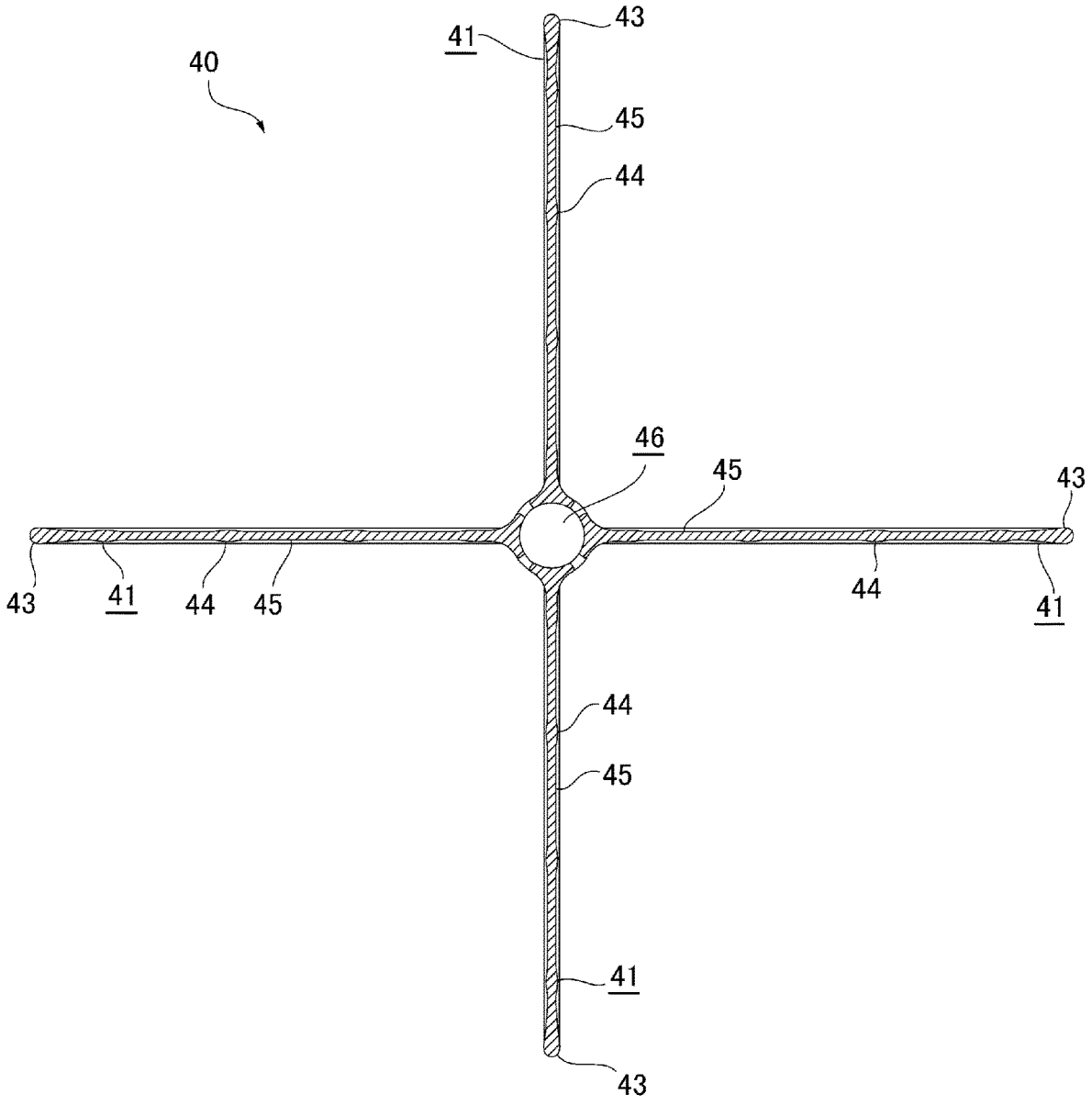
FIG. 6 is a view of a section taken along B-B in FIG. 2.

As shown in FIG. 3 through FIG. 6, flight 40 may comprise four fins 41 which might be provided in erect fashion at angular intervals of 90° about the axis, and central axial hole 46 which is formed along the central axis from the front end to the back end thereof. Note that FIG. 3 is a sectional view of a plane which contains the central axis of flight 40; (a) at FIG. 4 is a perspective view of flight 40 as seen from the front end thereof; and (b) at FIG. 4 is a perspective view of flight 40 as seen from the back end thereof.

Fin 41 might comprise fin rim 43 which may be formed so as to be of increased thickness along the outer edge thereof, and a mesh-like pattern of reinforcing ribs 44 which may protrude from planar portion 45 of fin 41. Reinforcing ribs 44 may be formed on both faces of fin 41.

Thickness of sheet-like fin 41 might be such that thickness of planar portion 45 is approximately 0.28 mm, thickness where reinforcing ribs 44 are formed is approximately 0.38 mm, and thickness of the portion at fin rim 43 is approximately 0.56 mm.

By thus causing the portions corresponding to reinforcing ribs 44 and fin rim 43 to be of increased thickness, it is possible—even where planar portion 45 has been made to be of decreased thickness and fin 41 has been imparted with flexibility—to cause fin 41 to be reinforced by fin rim 43 and mesh-like reinforcing ribs 44, and to achieve a lightweight constitution by which fin 41 is of high strength in terms of its ability to return to its original shape upon being deformed as a result of collision or the like.

Moreover, by causing fin rim 43 to be of increased thickness, not only will there be less tendency for cracking to occur in the first place but it will also be the case that even where there is occurrence of cracking it will be possible due to the fact that thickness is varied in alternating fashion between reinforcing ribs 44 and planar portions 45 for impact to be mitigated and for progress of cracking to be suppressed.

Mesh-like reinforcing ribs 44 might consist of a multiplicity of first projections which may intersect the axis of dart 1 at 45°, and a multiplicity of second projections which may intersect same axis at 135° and which may also intersect the first projections at right angles, such that the mesh openings are square. By thus causing the projections that make up reinforcing ribs 44 to be formed so as to intersect in mesh-like fashion, it is possible to smoothly carry out injection of resin during injection molding.

Central axial hole 46 may be formed in such fashion as to gradually become narrower as one proceeds from the front end to the back end of flight 40. Central axial hole 46 may open at the front end of flight 40 to form opening 47 at the front end thereof, but may be closed at the back end thereof. The reason for this is to permit resin to be smoothly injected into the interior of the die by causing the gate that will constitute the injection port when resin is injected thereinto from the axial hole end of flight 40 during manufacture of flight 40 to be increased in size. Of course, the back end of central axial hole 46 may also be open.

In accordance with the foregoing embodiment, it will be possible for insertion portion 35 of shaft 30 to be inserted into the interior of central axial hole 46 from opening 47 such that shaft 30 and flight 40 are coupled by virtue of a cap-like arrangement. At a location which is a prescribed length inward from opening 47 of central axial hole 46, protrusions 48—which may protrude toward the interior in radial direction perpendicularly with respect to the axial direction of dart 1—may be formed at six places in the circumferential direction.

In accordance with one embodiment, the locations of protrusions 48 might be locations in the axial direction such as will cause these to face the aforementioned groove recess 36 of shaft 30 when shaft 30 and flight 40 are coupled, in which case the inside diameter that connects the vertices of protrusions 48 would be slightly smaller than the outside diameter of insertion portion 35 with which these are opposed when coupled.

In accordance with such an embodiment, a constitution may be adopted in which when shaft 30 and flight 40 are coupled and connected, as insertion portion 35 which is inserted within central axial hole 46 comes in contact with protrusions 48 and causes central axial hole 46 to deform so as to slightly increase in size, protrusions 48 arrive at and engage with groove recess 36, as a result of which shaft 30 and flight 40 may be firmly connected, such that insertion portion 35 of shaft 30 is not easily dislodged from central axial hole 46 of flight 40.

As the material of flight 40, polypropylene (PP), polyimide (PA), polystyrene (PS), or other such synthetic resin may be used, it being possible for flight 40 to be integrally formed by injection molding. In accordance with the present embodiment, PP of specific gravity 0.9 might, for example, be used.

In accordance with the present embodiment, the length of insertion portion 35 of shaft 30 might, for example, be on the order of one-third of the axial length of flight 40, in which case it would be inserted therewithin to a length that is one-third of central axial hole 46 toward the front thereof. In contradistinction thereto, the reason that central axial hole 46 is in accordance with the present embodiment formed along the entire length in the axial direction of flight 40 is so as to suppress deformation of flight 40 during injection molding.

During injection molding, whereas thin-walled portions will in general have short cooling times and little shrinkage, thick-walled portions will in general have long cooling times and much shrinkage. Accordingly, if there are portions present along the central axis of flight 40 at which central axial hole 46 is provided and there are portions present therealong at which no hole is formed, to the extent that there are portions present therealong that are of very different thicknesses, as a result of the fact that a portion which takes more time to cool/solidify may be pulled on by a portion which takes little time to cool/solidify, there is a possibility that fins 41 of flight 40 might be subject to torsional deformation (fins 41 might no longer be able to maintain their 90° orientations, for example).

To address this, by in accordance with one embodiment causing central axial hole 46 to be formed along the entire length from the front end to the back end thereof and increasing uniformity with regard to shape, it is possible to suppress differences in cooling time and amount of shrinkage that would otherwise exist along the central axis of flight 40 and prevent occurrence of deformation at flight 40 during injection molding.

As described above, in accordance with the present embodiment, by causing fins 41 of flight 40 to be provided with mesh-like reinforcing ribs 44 of thickness greater than that of planar portions 45, it is possible to cause fins 41 to be of reduced thickness and to be imparted with flexibility, and for impact to be absorbed when another dart 1 collides with flight 40. Furthermore, by causing fins 41 to be of reduced thickness, it is possible to cause flight 40 to be made more lightweight.

Furthermore, even though fins 41 may have flexibility in accordance with the present embodiment, because they may be reinforced by reinforcing ribs 44 and fin rims 43, it is possible in accordance with the present embodiment to prevent unwanted deformation of fins 41 during flight and the like, permitting achievement of aerodynamic stability. Furthermore, even though fins 41 may be of reduced thickness in accordance with the present embodiment, because the portions at mesh-like reinforcing ribs 44 may be of increased thickness, it is possible in accordance with the present embodiment to smoothly carry out injection of resin during injection molding; and moreover, even where there is occurrence of cracking at fins 41, it will be possible in accordance with the present embodiment for progress of the cracking to be suppressed.

Variations 1 through 4 on the present embodiment will now be described with reference to FIG. 7 and FIG. 8. Because flights 40', 40", 40'", 40"" associated with Variations 1 through 4 are such that the constitutions of reinforcing ribs 44', 44", 44'", 44"" differ from that of the foregoing embodiment but the constitutions thereof are otherwise similar to that of the foregoing embodiment, description will primarily be given with respect to the portions that are different.

Figure 7:
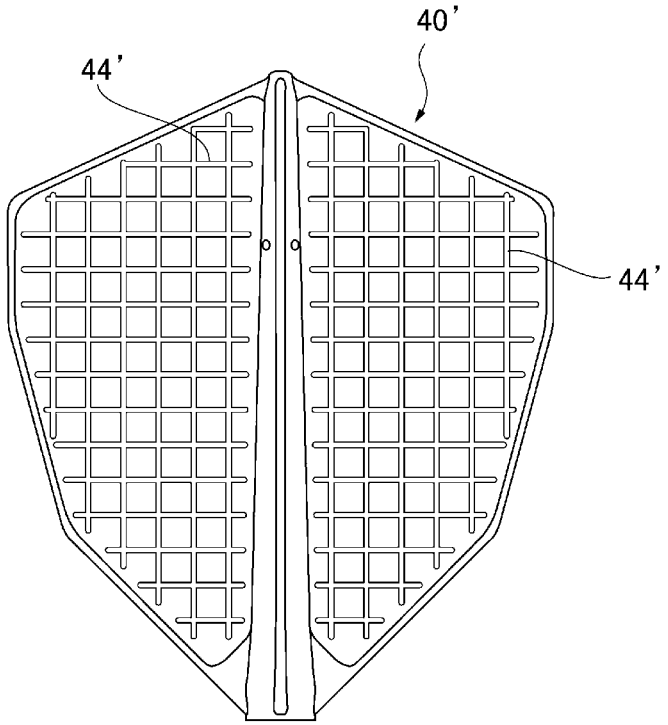
FIG. 7 is a drawing showing the constitution of a flight associated with a variation on an embodiment of the present invention.
Figure 7:
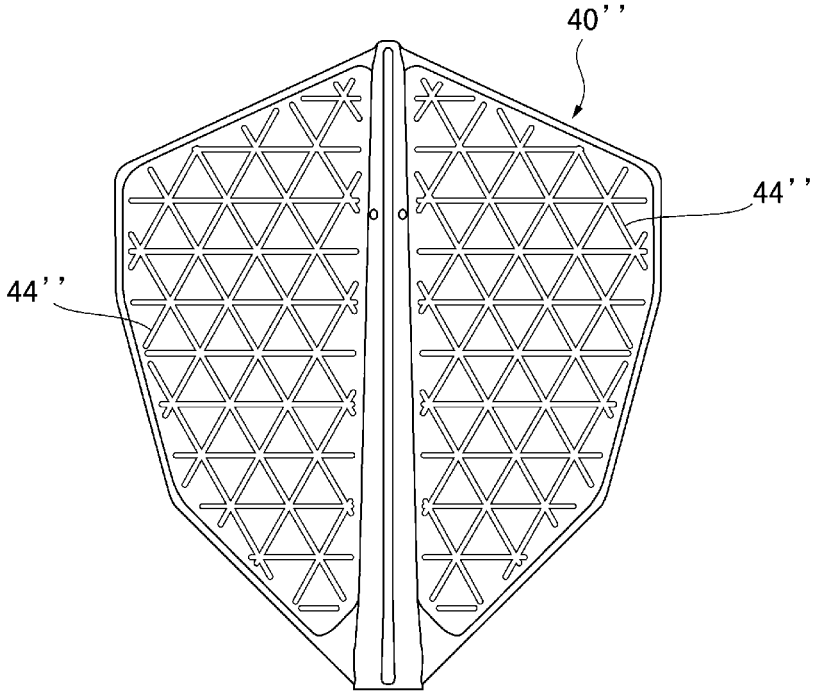
Figure 8:
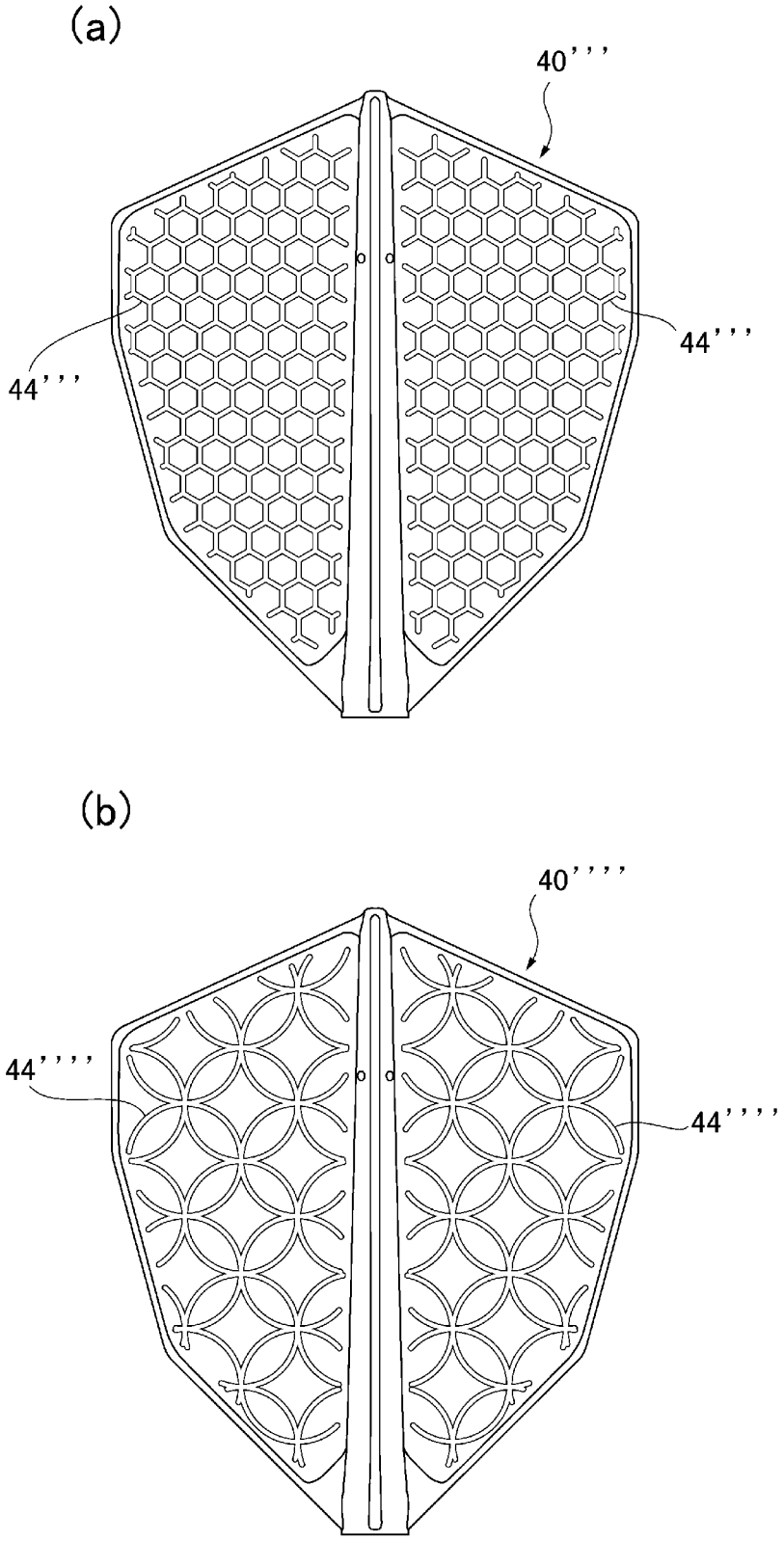
FIG. 8 is a drawing showing the constitution of a flight associated with a variation on an embodiment of the present invention.

(a) at FIG. 7 shows the constitution of reinforcing ribs 44' associated with Variation 1; (b) at FIG. 7 shows the constitution of reinforcing ribs 44" associated with Variation 2; (a) at FIG. 8 shows the constitution of reinforcing ribs 44'" associated with Variation 3; and (b) at FIG. 8 shows the constitution of reinforcing ribs 44"" associated with Variation 4.

Reinforcing ribs 44' associated with Variation 1 consist of first projections which are parallel to the axis of dart 1, and second projections which are perpendicular to same axis, such that the mesh openings are square. Reinforcing ribs 44" associated with Variation 2 consist of a multiplicity of first projections which intersect the axis of dart 1 at 45°, a multiplicity of second projections which intersect same axis at 135° and which also intersect the first projections at right angles, and third projections which are perpendicular to same axis, such that the mesh openings are triangular.

Reinforcing ribs 44'" associated with Variation 3 consist of projections having a honeycomb-like structure, such that the mesh openings are hexagonal. Reinforcing ribs 44"" associated with Variation 4 consist of arcuate projections, such that the mesh openings are shapes formed by combinations of arcs. Variations 1 through 4 will provide operation and effect similar to those of the foregoing embodiment.

While embodiments of the present invention including variations thereof have been described above, modes of carrying out the present invention are not limited to the foregoing embodiments, a great many variations being possible without departing from the gist of the present invention. For example, the shapes and sizes of the respective members that make up the dart may be varied as appropriate.

Furthermore, whereas at the foregoing embodiments the point, barrel, shaft, and flight that served as members which make up the dart were separate bodies, these being coupled and secured to constitute the dart, all or any portion of the constituent members may be integrally formed. For example, the shaft and flight may be integrally formed from the outset—i.e., these may be formed as a single part, thus obviating the need for these to be later assembled from separate parts—by injection molding.

Furthermore, whereas at the foregoing embodiments the flight comprised four fins, there may be two or three or five or more thereof.

Furthermore, thicknesses of fin rims, reinforcing ribs, and planar portions of fins may be varied as appropriate, it being sufficient in accordance with a preferred embodiment that thickness be greater at fin rims and reinforcing ribs than at planar portions. Note, however, that because the peripheral portion of the fin is the most prone to damage, it is preferred as was the case at the foregoing embodiments that the thickness of the fin rim be greater than that of the reinforcing ribs.

Furthermore, whereas at the foregoing embodiments the fin rims, reinforcing ribs, and planar portions were each of constant thickness, thickness may be varied depending on location. For example, thickness at the planar portions of the fin may be greater in the back half thereof than in the front half thereof.

Furthermore, whereas at the foregoing embodiments reinforcing ribs were provided over the approximate entirety of the fin, these need not be provided over the entirety thereof. For example, the region in one half of the fin might be made to be of decreased thickness and be provided with reinforcing ribs, and the fin might be made to be of increased thickness in the remaining half thereof.

So that the fins might be of reduced thickness, be made lightweight, and be imparted with flexibility, note, however, that it is preferred that mesh-like reinforcing ribs be formed in a region that is not less than one-half of the fin, and more preferred that reinforcing ribs be formed in a region that is not less than two-thirds thereof.

Furthermore, whereas at the foregoing embodiments reinforcing ribs were formed on both faces of the fin, it is also possible for these to be formed on only one face thereof.

EXPLANATION OF REFERENCE NUMERALS

1 Dart
10 Point
20 Barrel
30 Shaft
31 Male threads
35 Insertion portion
36 Groove recess
40 Flight
41 Fin
43 Fin rim
44 Reinforcing rib
45 Planar portion
46 Central axial hole
47 Opening
48 Protrusion

The invention claimed is:

1. A dart comprising—in order from a front thereof—a point, barrel, shaft, and flight, wherein
- the flight comprises a plurality of substantially planar fins; and
- the fins comprise mesh-like reinforcing ribs that protrude from the substantially planar fins so as to cause the fins to be of increased thickness at the ribs.

2. The dart according to claim 1 wherein the fins further comprise, at peripheries thereof, fin rims formed so as to be of increased thickness.

3. The dart according to claim 2 wherein
- the reinforcing ribs protrude so as to be of uniform rib height;
- the fin rims protrude so as to be of uniform rim height; and
- the rib height is less than the rim height.

4. The dart according to claim 1 wherein the reinforcing ribs are formed over the approximate entireties of the fins.

5. The dart according to claim 1 wherein
- the shaft comprises an insertion portion at a back end thereof;
- the flight further comprises a central axial hole having an opening at a front end thereof; and
- the shaft and the flight are constituted so as to be removably installable by causing the insertion portion to be inserted within, and coupled and secured to, the central axial hole.

6. The dart according to claim 5 wherein
- the central axial hole is formed from the front end of the flight to a back end thereof.

7. The dart according to claim 5 wherein
- the plurality of fins and a portion of the flight in which the central axial hole is formed are integrally molded by injection molding.

8. A flight for a dart constituted so as to be removably installable with respect to a shaft of the dart, wherein
- the flight comprises a plurality of substantially planar fins; and
- the fins comprise mesh-like reinforcing ribs that protrude from the substantially planar fins so as to cause the fins to be of increased thickness at the ribs.

9. The flight according to claim 8 wherein the fins further comprise, at peripheries thereof, fin rims formed so as to be of increased thickness.

10. The flight according to claim 9 wherein
- the reinforcing ribs protrude so as to be of uniform rib height;
- the fin rims protrude so as to be of uniform rim height; and
- the rib height is less than the rim height.

11. The flight according to claim 8 wherein the reinforcing ribs are formed over the approximate entireties of the fins.

12. The flight according to claim 8 wherein
- the flight further comprises a central axial hole having an opening at a front end thereof; and
- the central axial hole of the flight is capable of being coupled to and secured by an insertion portion at a back end of the shaft when the insertion portion of the shaft is inserted within the central axial hole of the flight.

13. The flight according to claim 12 wherein
- the central axial hole is formed from the front end of the flight to a back end thereof.

14. The flight according to claim 12 wherein
- the plurality of fins and a portion of the flight in which the central axial hole is formed are integrally molded by injection molding.

15. A flight for a dart constituted so as to be removably installable with respect to a shaft of the dart, wherein
- the flight comprises a plurality of substantially planar fins and a central axial hole having an opening at a front end thereof; and
- the fins comprise mesh-like reinforcing ribs that protrude from the substantially planar fins so as to cause the fins to be of increased thickness at the ribs; and the plurality of fins and a portion of the flight in which the central axial hole is formed are integrally molded by injection molding.

16. The flight according to claim 15 wherein the fins further comprise, at peripheries thereof, fin rims formed so as to be of increased thickness.

17. The flight according to claim 16 wherein the reinforcing ribs protrude so as to be of uniform rib height;

the fin rims protrude so as to be of uniform rim height; and the rib height is less than the rim height.

18. The flight according to claim 15 wherein the reinforcing ribs are formed over the approximate entireties of the fins.

19. The flight according to claim 15 wherein the central axial hole of the flight is capable of being coupled to and secured by an insertion portion at a back end of the shaft when the insertion portion of the shaft is inserted within the central axial hole of the flight.

20. The flight according to claim 19 wherein the central axial hole is formed from the front end of the flight to a back end thereof.

* * * * *